US006124833A

United States Patent [19]

Bialkowski et al.

[11] Patent Number: 6,124,833

[45] Date of Patent: Sep. 26, 2000

[54] RADIAL LINE SLOT ANTENNA

[75] Inventors: Marek Edward Bialkowski; Paul William Davis, both of Brisbane, Australia

[73] Assignee: The University of Queensland, Queensland, Australia

[21] Appl. No.: 09/331,229

[22] PCT Filed: Dec. 16, 1997

[86] PCT No.: PCT/AU97/00848

§ 371 Date: Aug. 12, 1999

§ 102(e) Date: Aug. 12, 1999

[87] PCT Pub. No.: WO98/27615

PCT Pub. Date: Jun. 25, 1998

[30] Foreign Application Priority Data

Dec. 18, 1996 [AU] Australia ..... PO 4250

[51] Int. Cl.[7] ..... H01Q 13/10

[52] U.S. Cl. ..... 343/770; 343/771

[58] Field of Search ..... 343/767, 770, 343/771, 700 MS

[56] References Cited

U.S. PATENT DOCUMENTS

| | | | |
|---|---|---|---|
| 4,689,629 | 8/1987 | Traut et al. | 343/770 |
| 4,967,077 | 10/1990 | Watson | 343/770 |
| 5,438,697 | 8/1995 | Fowler et al. | 343/700 MS |
| 5,661,498 | 8/1997 | Goto et al. | 343/771 |
| 5,726,666 | 3/1998 | Hoover et al. | 343/767 |
| 5,745,083 | 4/1998 | Uematsu et al. | 343/770 |

FOREIGN PATENT DOCUMENTS

| | | |
|---|---|---|
| 1 136 267 | 11/1982 | Canada . |
| 0 149 922 | 7/1985 | European Pat. Off. . |
| 2 651 926 | 3/1991 | France . |
| WO 98/27615 | 6/1998 | WIPO . |

OTHER PUBLICATIONS

"A Reflection Cancelling Slot Set in a Linearly Polarized Radial Line Slot Antenna," IEEE Transactions On Antennas and Propogation, vol. 40, No. 4, Apr. 1992.

"Experimental Investigations into a Linearly Polarized Radial Slot Antenna for DBS TV in Australia," IEEE Transactions On Antennas and Propogation, vol. 45, No. 7, Jul. 1997.

*Primary Examiner*—Tan Ho

*Attorney, Agent, or Firm*—Nixon & Vanderhye P.C.

[57] ABSTRACT

A flat radial line slot antenna having a radial waveguide is disclosed. The antenna has a front plate and a rear plate, the front plate having an array of radiating slots and an array of reflection cancelling slots formed in the rear plate.

22 Claims, 5 Drawing Sheets

Fig. 3
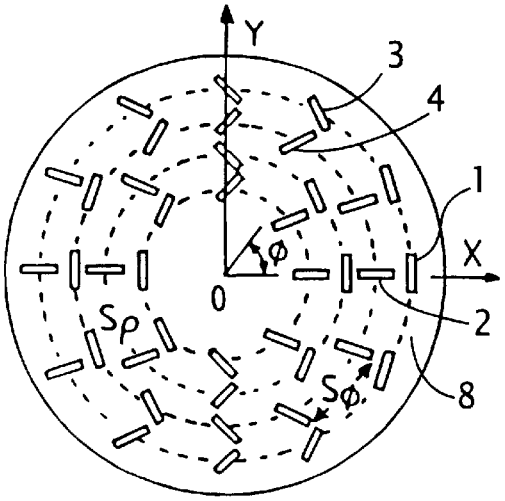
Fig. 5
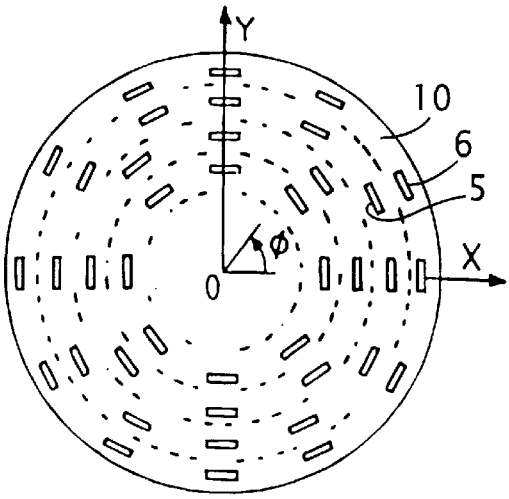
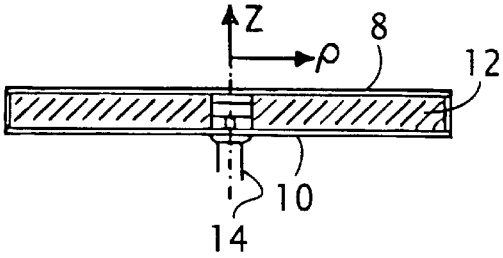
Fig. 4
| | |
|---|---|
| Operating Frequency, $f_0$ | 12.5 GHz |
| Antenna Radius, $\rho_{max}$ | 275 mm |
| Blocking Radius, $\rho_{min}$ | 29.29 mm |
| Waveguide Height, d | 6mm |
| Dielectric Constant, $\varepsilon_r$ | 2.33 |
| Radiating Slot Length, $L_R$ | 5.15–7.46 mm |
| Reflection Canceling Slot Length, $L_D$ | 5.15–6.68 mm |
| Slot Width, W | 1 mm |
| Number of Rings | 16 |
| Number of Slots | 4864 |
Fig. 6

= Radiating Slot

= Reflection Cancelling Slot on Front OR Rear Surface $L_{r_x}$ = Length of a Radiating Slot $L_{c_x}$ = Length of a Reflection Cancelling Slot

RADIAL LINE SLOT ANTENNA

THIS INVENTION relates to radial line slot antenna (RLSA). In particular, the invention concerns a linearly polarised radial line slot antenna for direct broadcasting by satellite (DBS).

BACKGROUND OF THE INVENTION

The antenna of the invention may be used for transmission and reception of signals. Whilst the invention will be described with reference to receiving signals, this is by way of example only. In addition, the invention will be described with reference to linear polarisation by way of example. Polarisation such as circular, elliptical, horizontal and vertical polarisation are not excluded.

The antenna of the invention is particularly suited for satellite signal reception and the invention will be described by way of example with reference to this application.

Satellite broadcasting systems employ a satellite station at which signals are received, down converted to a frequency typically about 11 or 12 GHz and boosted by high power amplifiers before re-transmission back to earth. By the time the downlink signals reach the earth, they are extremely weak and specialist equipment is necessary to produce acceptable received signals.

Direct broadcasting by satellite (DBS) is now used for domestic purposes and adequate signals may be received in some areas by using a 65 cm dish antenna. For effective reception, the antenna should be small, easy to construct and consistently receive signals for most of the time. The antenna should have high gain, high directivity, good efficiency and a narrow bandwidth.

Flat-plate array antennas have been proposed for receiving DBS transmissions. For high power DBS applications, flat plate antennas offer an attractive alternative to conventional reflectors in terms of aesthetics, ease of installation and maintenance.

In conventional linearly polarised flat RLSA antennas, reflections occur in radiating slots provided in a flat plate. Such RLSA antennas were proposed and used in Japan. Various designs of both a circular and linearly polarised were suggested. One known RLSA circular polarised antenna had a radial waveguide with radiating slots arranged spirally which produced a circular polarised broadside beam. In order to increase efficiency, the upper part of the waveguide was filled with a dielectric material to suppress grating lobes in the array. Reception or transmission was at the centre of the lower waveguide via a coaxial cable.

A single layer RLSA antenna was also proposed. Its operation was similar to the double layer structure referred to above and had slots arranged in a spiral pattern in a plate provided on the antenna.

An RLSA antenna having slots arranged in concentric paths on the plate was also previously suggested.

Linearly polarised RLSA antennas are also known and produce a linearly polarised broadside beam. The configuration of such antennas was similar to circular polarised RLSA antennas except that the slots were annularly arranged. Such linearly polarised antennas exhibited poor return loss characteristics. The main reason for this was that slot reflections were added in phase since the slots were arranged for linear polarisation.

One technique for improving the return loss of linearly polarised RLSA antennas employed a beam tilting technique. An improvement in the return loss of 10 dB was reported for a tilt angle of 10°. However, reflections from slots were not greatly suppressed.

A technique known as reflection cancelling has been suggested to suppress reflections caused by slots in the antenna. This method involved using additional slots spaced $\lambda_g/4$ from the radiating slots for cancellation of reflections, where $\lambda_g$ is the guide wavelength. It is possible to provide an antenna with reflection cancelling slots and non-uniform slots for providing optimum performance but this is difficult, particularly since the respective slots should not overlap. In addition, slot coupling control is not fully realised by using nonuniform slots not designed to optimum length to avoid overlapping.

SUMMARY OF THE INVENTION

It is an object of the present invention to provide a radial line slot antenna (RLSA) which at least minimises some of the disadvantages referred to above.

According to one aspect, the invention provides a flat, radial line slot antenna having a radial waveguide including a front plate and a rear plate, the front plate being provided with an array of radiating slots formed therein and an array of reflection cancelling slots formed in the rear plate.

The two plates are spaced apart from one another and have a dielectric material between them. Any suitable dielectric material may be used. Preferably the dielectric material is polypropylene and has a permittivity of $_{er}$=2.33. A preferred thickness for the dielectric material is about 6 mm although other thicknesses may also be used.

The antenna may have radiating slots of unequal or equal length. Preferably, the radiating slots in the front plate are of unequal length. Where the antenna is designed for a signal having a frequency of 12.5 GHz, the radiating slots may vary in length from about 5.15 to about 7.46 mm. Preferably slots near the centre of the plate are shorter in length than slots located further from the centre.

The radiating slots in the front plate may be arranged in a spiral or annular pattern. Preferably, the radiating slots are arranged in an annular pattern in the front plate and extend through the front plate forming concentric rings of slots in the front plate.

Preferably, a central area of the front plate is devoid of radiating slots The central area or blocking area may have any suitable radius. The blocking area may have a radius of approximately twice the guide wavelength and allows for the inner field to stabilise. For an operating frequency of 12.5 GHz, the blocking area may have a minimum radius of about 29 mm.

The reflection cancelling slots are placed in parallel and are arranged either spirally or annularly to suit the configuration adopted for the radiating slots. The reflection cancelling slots introduce reflections combined in antiphase with those produced from radiating slots.

Preferably, the reflection cancelling slots are offset from the radiating slots by a predetermined distance.

Where the front plate has a blocking area devoid of slots, it is preferred that the rear plate has a correspondingly sized block area also devoid of slots. Preferably, the reflection cancelling slots are of a non-uniform length. The length of the slots is governed by the frequency for which the antenna is designed. Where the frequency is 12.5 GHz it is preferred that the reflection cancelling slots have a length between 5.15 to 6.68 mm. The slots nearer the blocking area are preferably shorter than those further from that area.

The reflection cancelling slots are radially spaced from the radiating slots. The reflection cancelling slots may be spaced $\lambda_g/4$ from the radiating slots.

BRIEF DESCRIPTION OF THE DRAWINGS

A particular preferred embodiment of the invention will now be described by way of example with reference to the drawings in which:

FIG. 3 shows a front view of a double-sided linearly polarised RLSA antenna according to an embodiment of the invention;

FIG. 4 is a diametric sectional view of the antenna of FIG. 3;

FIG. 5 is a rear view of the antenna of FIG. 3;

FIG. 6 is a table showing typical parameters of a linearly polarised RLSA antenna of an embodiment of the invention;

DESCRIPTION OF THE PREFERRED EMBODIMENT

The slots in the front plate of the antenna are of non-uniform length to minimise degradation in aperture field distribution. Shorter slots are used near the centre of the plate to create weak coupling and the length of the slots is gradually increased for slots progressing towards the edge of the plate.

Figure 1:
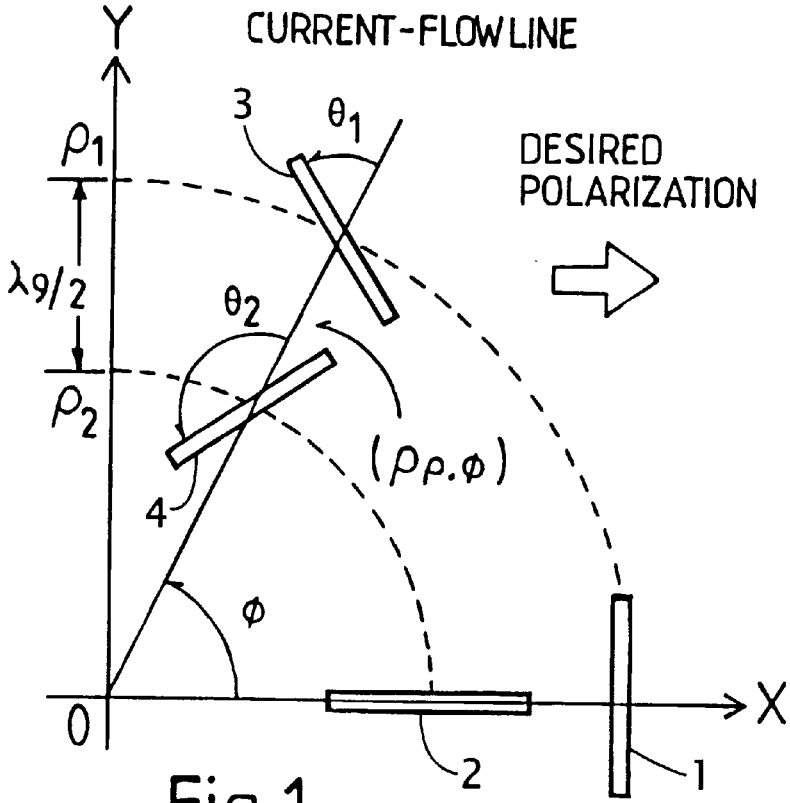
FIG. 1 is a view of radiating slots useful in illustrating the relationship of slots for linear polarisation.

The coordinates of radiating slots for a linearly polarised RLSA antenna are shown in FIG. 1. The desired polarisation indicated by an arrow is parallel to the X axis in FIG. 1. To obtain linear polarisation, the phase difference between two adjacent slots, #1 and #2 in a unit radiator is either 0° or 180°. Therefore, the distance between the two slots is radially spaced by λg/2, half of the guide wavelength.

The position and direction of each slot are given as i) ρ, the radial distance from the centre ii) ϕ, the angle of the current flow line; and iii) θ, the angle between the slot and the current flow line.

The presence of a dielectric within the plates of the antenna has the effect of reducing the guide wavelength $\lambda_g$ from the free-space wavelength $\lambda_o$ defined as $$\lambda g = \lambda o / \sqrt{\varepsilon} r \tag{1}$$

The parameters (i), (ii) and (iii) are based on the slot excitation field requirements as derived in equation (7), (8) below. Assuming weak slot coupling, the slot excitation field is approximated as $$F(\rho) \alpha e^{jkg\rho} \tag{2}$$

Where Kg is the waveguide number in the waveguide.

The excitation of slots which is proportional to the inner field except the effects caused by slot orientation is given by $$g = e^{jKg\rho} \cdot \sin\theta \tag{3}$$

From equation (3), normalised by $e^{jkge}$ gives $$\beta \begin{bmatrix} 1 \\ 2 \end{bmatrix} = \begin{bmatrix} + \\ - \end{bmatrix} \sin\theta \begin{bmatrix} 1 \\ 2 \end{bmatrix} \tag{4}$$

At the antenna boresight, the polarisation is perpendicular to its slot and the radiation from each unit radiator is polarised as co-polarisation:

$$\beta_1 \sin(\theta_1 + \phi) + \beta_2 \sin(\theta_2 + \phi) \tag{5}$$

cross polarised $$-\beta_1 \cos(\theta_1 + \phi) + \beta_2 \cos(\theta_2 + \phi) \tag{6}$$

By substituting equation (4) into equations (5) and (6), the final polarisation requirements are obtained in the form of $$\sin\theta_1 \sin(\theta_1 + \phi) - \sin\theta_2 \sin(\theta_2 + \phi) = 1 \tag{7}$$

$$-\sin\theta_1 \cos(\theta_1 + \phi) - \sin\theta_2 \cos(\theta_2 + \phi) = 0 \tag{8}$$

From these expressions, equation (7) agrees with the uniform aperture distribution while equation (8) indicates cross-polarisation cancellation. Equations (7) and (8) are then solved for $\theta_1$ and $\theta_2$ where $$\theta_1 = \pi/2 - \phi/2 \tag{9}$$

$$\theta_2 = \pi - \phi/2 \tag{10}$$

In order to satisfy the co-phasal condition, all unit radiators are arranged annularly in the p direction with radial spacing given as $$\rho_{odd} = \rho_1 + _ll \lambda_R \quad \text{for slot } 2m - 1 \tag{11}$$

$$\rho_{even} = \rho_2 + _ll \lambda_g \quad \text{for slot } 2m \tag{12}$$

where n and m are integers.

Therefore, the slot arrangement for a linearly polarised RLSA antenna can be summarised as i) Two slots in a unit radiator are perpendicular to each other and radially spaced by a half of the guide wavelength $\lambda_g/2$.

ii) Slot at ϕ is rotated by an angle of ϕ/2 around its center with respect to its orientation at ϕ=0°.

iii) The radial spacing $S_\rho$ between adjacent unit radiators equals $\lambda_g$ while the angular spacing $S_\phi$ is determined arbitrary.

iv) Unit radiators are distributed over the aperture and spaced closer than the free-space wavelength so that grating lobes are suppressed.

Reflections from slots are presented in linearly polarised RLSA antenna and cause poor performance in its efficiency. Seriously degraded return loss characteristics of 3 dB in the desired band of frequency occur. The contributions in the poor return loss characteristics are due to i) Reflected waves from two slots of an unit radiator are added in phase since they are spaced by $\lambda_g/2$ along the ρ-direction; and ii) Reflected waves from all unit radiators are added in phase at the input port since they are arrayed annularly with spacing of $\lambda_g$.

The return loss characteristics in linearly polarised RLSA antenna can be improved by i) Applying beam-tilting technique; and ii) Adding non-radiating slots for reflection cancellation.

The beam-tilting design technique involves tilting the maximum radiating beam away from the boresight direction so that phases of reflected waves from the slots do not coincide. An improvement of 10 dB in return loss is possible when the beam was tilted by 10°. However, the asymmetrical slots arrangement of this design disturbs the rotational symmetry of the inner field. If the tilt angle is too large, grating lobes may be generated in the radiation pattern.

Figure 2:
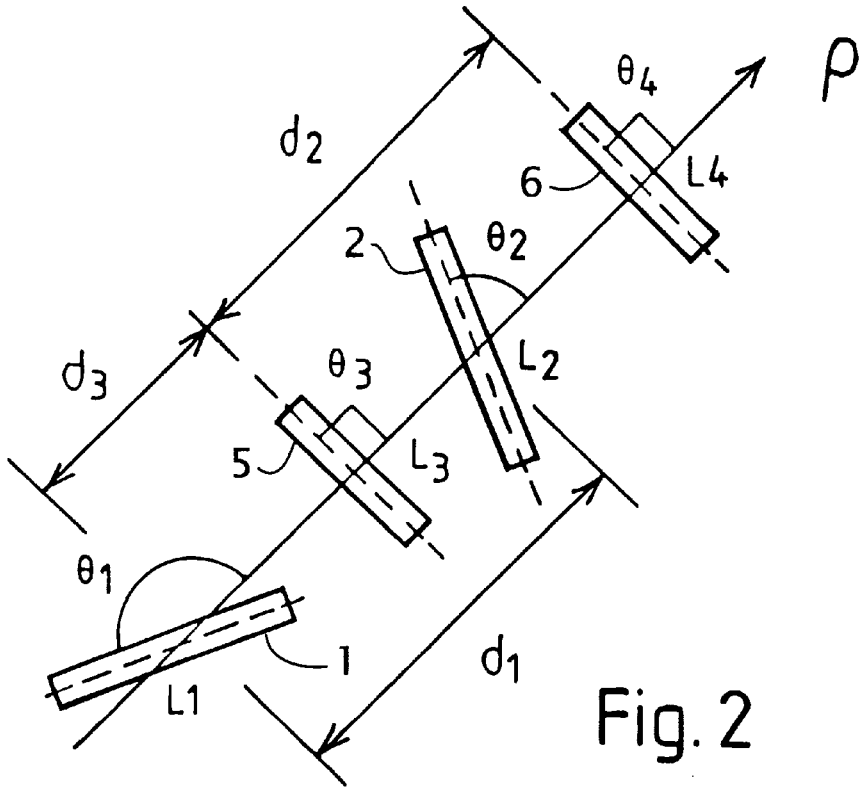
FIG. 2 is a view showing the relationship between radiating slots in the front plate and reflection cancelling slots in the rear plate of an antenna.

The geometry of a slot set with reflection cancelling slots is shown in FIG. 2. Two additional slots 5, 6 are placed in parallel at a radial distance of $\lambda_g/4$ from the radiating slots 1, 2. These slots introduce additional reflections where they are combined in anti-phase with those from the radiating slots. In this manner, all the reflected waves are effectively suppressed at the input port. Radiation from the additional slots are small, because they are separated by $\lambda_g/2$, which is less than $\lambda_g/2$, and are excited in alternating phase. To further minimise radiation, shorter length are incorporated in the reflection cancelling slots.

The basic concepts for suppressing the reflection are expressed as $$d_2=\lambda_g/2 \tag{13}$$

$$\theta_3=\theta_4(=\pi/2) \tag{14}$$

In a full wave analysis carried out in [10], the reflection cancellation are optimum when the position of the reflection cancelling slots were offset from the radiating slots by a distance of _ρ. Therefore, $$d_3=\lambda_g/4+_\rho \tag{15}$$

and the reflections cancelling slots length are given by $$L_3=L_4=L_D \tag{16}$$

The basic antenna element of the linearly polarised RLSA antenna consists of two conducting plates 8, 10, a dielectric material 12 and a feed probe 14. In the design of the antenna, the two plates are spaced a distance d apart with the dielectric material formed between them. In this manner, a radial waveguide is formed. At the center of the lower conducting plate, the feed probe is positioned with its exposed end inserted in the radial cavity so that power is transferred symmetrically into a radially outward travelling wave.

An overall aperture of 550 mm in diameter gives a reasonable number of slots or optimum gain the radiation pattern. The dielectric material chosen for the radial cavity is polypropylene, which has a permittivity of $\epsilon_r$=2.33 and a thickness of 6 mm.

The antenna illustrated is designed to operate at the frequency band of 12.5 GHz, the guide wavelength $\lambda_g$ is calculated to be 15.71 mm based on Equation (1). Hence, this forms the radial spacing $S_\rho$ between slot pairs. The manner in which the radiating slots are arranged determine the characteristics of the antenna. Ideally, this antenna should possess very high efficiency and gain the operating frequency. Thus, if the slots are arrayed according to Equations (7) to (12), the characteristics of linear polarisation outlined in that section could be achievable.

The design of the linearly polarised RLSA antenna must include reflections and slot coupling control for optimum performance it is possible to implement these with the reflection cancelling slots and non-uniform slots, each of which is carefully determined to fulfil the required properties of an ideal linearly polarised RLSA antenna. Reflection cancelling slot pattern on the rear plate of the antenna is shown in FIG. 5. Both plates are needed to support the travelling wave in the radial waveguide. In this manner, any physical overlapping of slots can be avoided and the slots can be optimised to its resonant length. The structure of the double-sided linearly polarised RLSA antenna is shown in FIGS. 3 to 5.

The slots are varied in length between 5.15 to 7.46 mm. A blocking radius, approximately twice the guide wavelength, is incorporated in this embodiment to allow the inner field to stabilise. The table of FIG. 6 summarises the detailed slot design of the preferred antenna.

Figure 7:
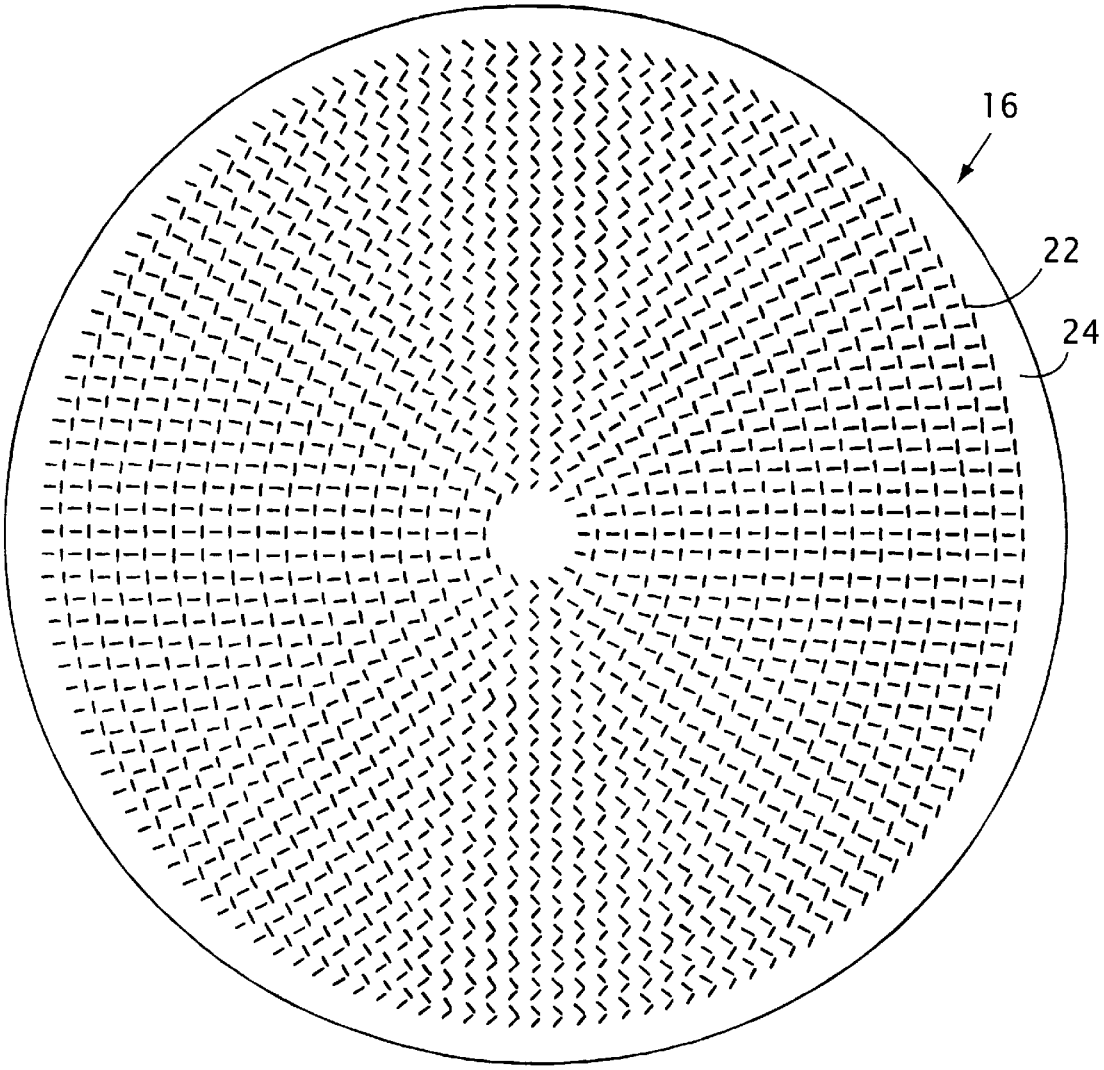
FIG. 7 is a front view of an antenna according to an embodiment of the invention.
Figure 8:
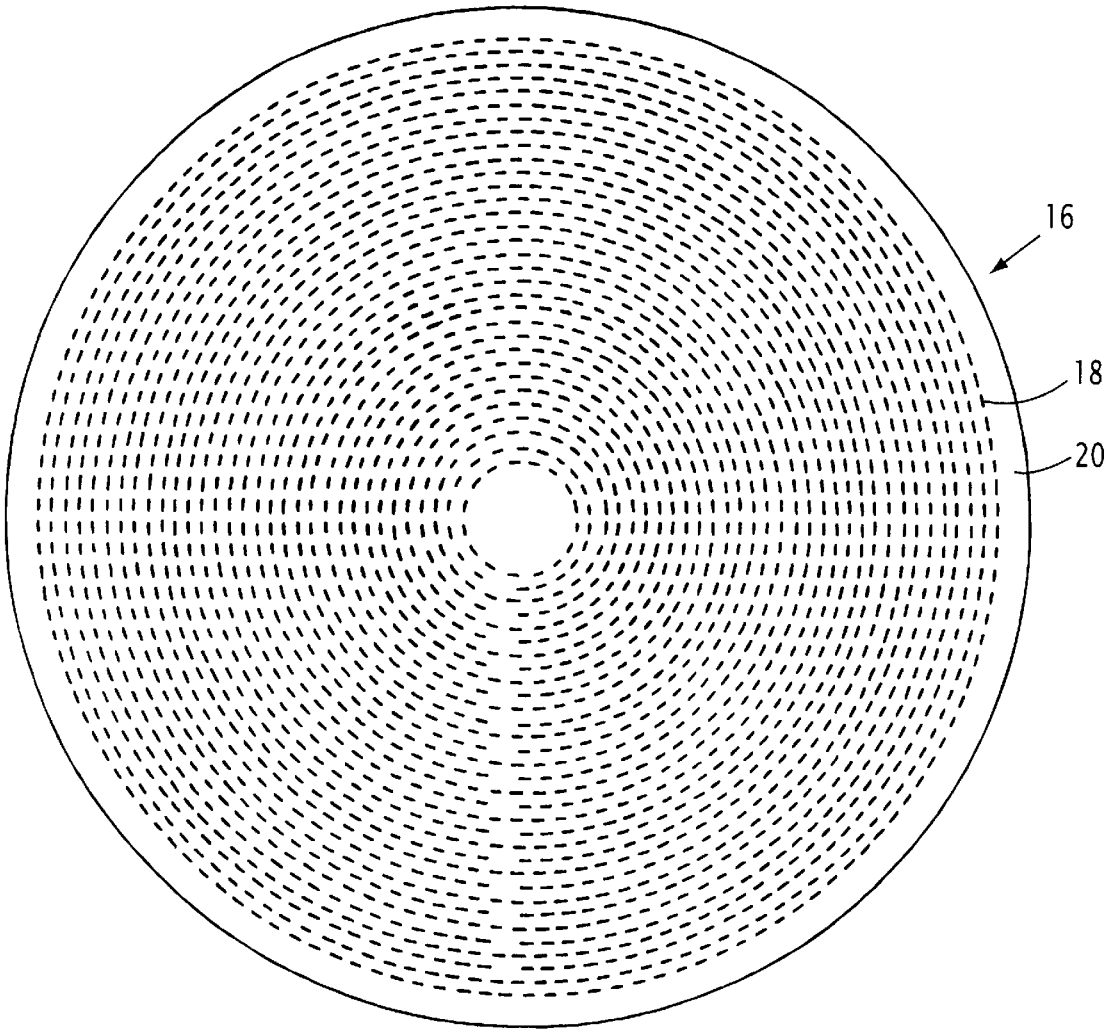
FIG. 8 is a rear view of an antenna according to an embodiment of the invention.

FIGS. 7 and 8 show front and rear views respectively of an antenna 16 made in accordance with the invention. By having the reflection cancelling slots 18 on the rear plate 20 of the antenna the properties of the antenna can be optimised and the problems of overlap where both types of slots are in the same plate of an antenna can be avoided. The radiating slots 22 on front plate 24 can then be non-uniform to have them at an optimum length.

Figure 9:
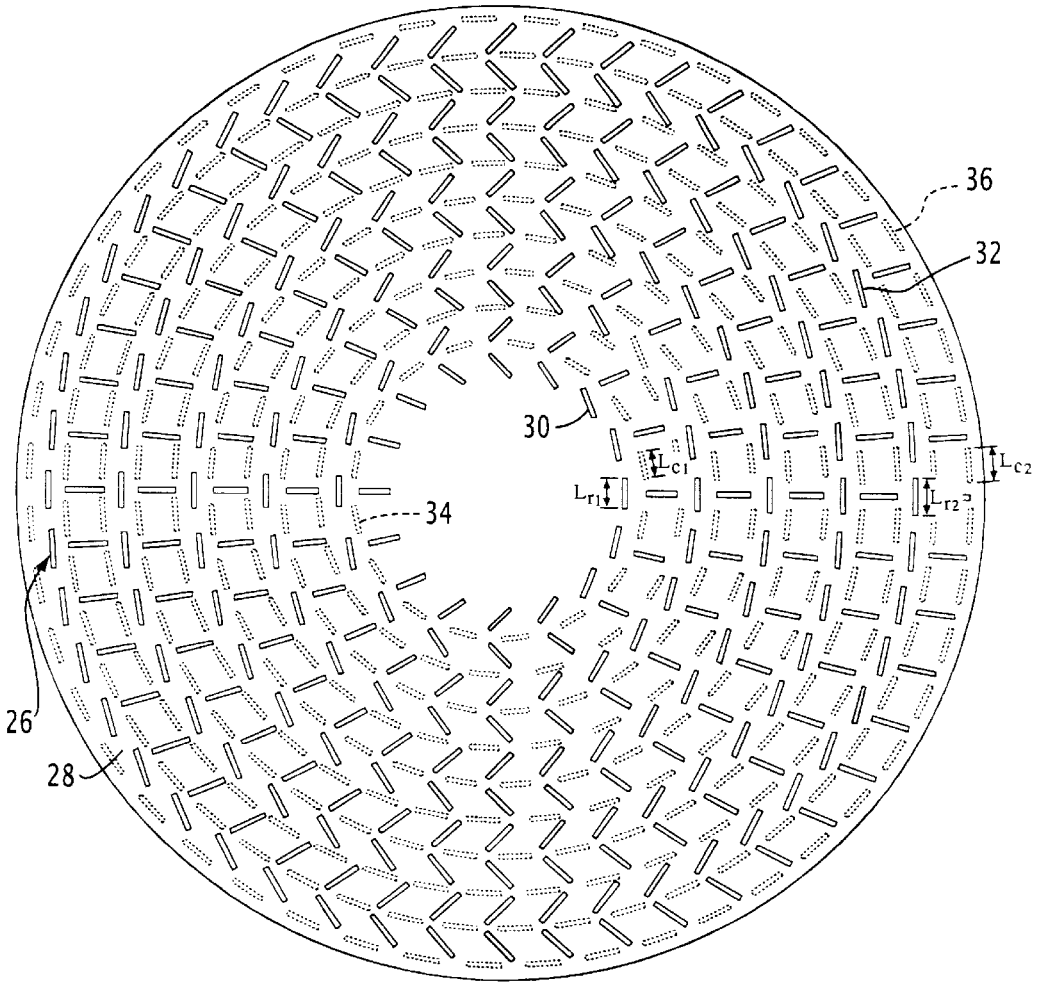
FIG. 9 is a front view of an antenna according to an alternative embodiment of the invention.

FIG. 9 shows an antenna in accordance with an alternative embodiment of the invention where the radiating slots 26 on the front face 28 of the antenna have different lengths. Specifically, radiating slots 30 near the center of the front plate 28 are shorter in length than radiating slots 32 located further from the center of the front plate. Similarly, reflection canceling slots 36 near the center of the antenna on the rear plate of the antenna are shorter than the canceling slots 36 further from the central area of the antenna.

What is claimed is:

1. A flat, radial line slot antenna having a radial waveguide including a front plate and a rear plate, the front plate being provided with an array of radiating slots formed therein and an array of reflection cancelling slots formed in the rear plate.

2. The antenna of claim 1 wherein the front and rear plates are spaced from one another and have a dielectric material between them.

3. The antenna of claim 2 wherein the dielectric material is polypropylene having a permittivity of 2.33.

4. The antenna of claim 2 wherein the dielectric material has a thickness of about 6 mm.

5. The antenna of claim 1 wherein the radiating slots are all of the same length.

6. The antenna of claim 5 wherein the radiating slots have a length between 5.15 mm to 7.46 mm.

7. The antenna of claim 1 wherein the radiating slots are of differing lengths.

8. The antenna of claim 6 wherein the radiating slots near the centre of the front plate are shorter in length than the radiating slots located further from the centre of the front plate.

9. The antenna of claim 1 wherein a central area of the front plate is devoid of radiating slots.

10. The antenna of claim 9 wherein the central area devoid of said radiating slots has a radius of about twice a guide wavelength.

11. The antenna of claim 10 wherein the radius of the central area is about 29 mm.

12. The antenna of claim 9 wherein a central area of the back plate is devoid of said reflection cancelling slots.

13. The antenna of claim 12 wherein reflection the cancelling slots are of a non-uniform length.

14. The antenna of claim 13 wherein the reflection cancelling slots have a length between 5.15 mm to 6.68 mm.

15. The antenna of claim 12 wherein the reflection cancelling slots nearer the central area are shorter than the reflection cancelling slots further from the central area.

16. The antenna of claim 1 wherein it is linearly polarised.

17. The antenna of claim 1 wherein it is either circularly, elliptically, horizontally or vertically polarised.

18. A flat, radial line slot antenna having a radial waveguide including a front plate and a rear plate, the front plate being provided with an array of radiating slots formed therein and an array of reflection cancelling slots formed in the rear plate, wherein the radiating slots in the front plate are arranged in a spiral pattern.

19. The antenna of claim 18 wherein the reflection cancelling slots are arranged in parallel and in a pattern corresponding to the pattern of the radiating slots.

20. The antenna of claim 19 wherein the reflection cancelling slots are offset from the radiating slots by a predetermined distance.

21. The antenna of claim 20 wherein the reflection cancelling slots are offset from the radiating slots by $\lambda_g/4$ where $\lambda_g$ is the guide wavelength.

22. A flat, radial line slot antenna having a radial waveguide including a front plate and a rear plate, the front plate being provided with an array of radiating slots formed therein and an array of reflection cancelling slots formed in the rear plate, wherein the radiating slots in the front plate are arranged in an annular pattern and form concentric rings of slots in the front plate.

* * * * *